US007614624B2

(12) United States Patent
Kling et al.

(10) Patent No.: US 7,614,624 B2
(45) Date of Patent: Nov. 10, 2009

(54) WILD VIKING ROULETTE

(76) Inventors: Werner Alecsander Kling, 5 Element AS, Munkerudvolien 7 A, Oslo (NO) 1165; Hugo Hagen, 5 Element AS, Munkerudvolien 7 A, Oslo (NO) 1165

( * ) Notice: Subject to any disclaimer, the term of this patent is extended or adjusted under 35 U.S.C. 154(b) by 187 days.

(21) Appl. No.: 11/549,660

(22) Filed: Oct. 16, 2006

(65) Prior Publication Data

US 2008/0088086 A1 Apr. 17, 2008

(51) Int. Cl.
*A63F 5/00* (2006.01)

(52) U.S. Cl. ..... 273/274; 273/292

(58) Field of Classification Search ..... 273/274, 273/292, 309, 142 R, 142 E, 142 F, 142 G; 463/13, 17

See application file for complete search history.

(56) References Cited

U.S. PATENT DOCUMENTS 4,149,728 A * 4/1979 Thompson ..... 273/274
6,059,659 A * 5/2000 Busch et al. ..... 463/17
6,264,200 B1 * 7/2001 Smith ..... 273/274
2001/0015529 A1 * 8/2001 Allen ..... 273/292

* cited by examiner

*Primary Examiner*—Benjamin H Layno
(74) *Attorney, Agent, or Firm*—Jennifer Joan Riel; Riel Law

(57) ABSTRACT

Disclosed is modified roulette game wherein a plurality of values are selected and analyzed during each round of play. A set of predetermined playing cards is used to determine values that determine the outcome of bets. The gaming method includes: dealing a plurality of community cards from a predetermined set of cards and using a predetermined community card (e.g., last card dealt) to determine the result of all roulette-type bets. The player may also make optional side bets based on the outcome of two or more of the community cards dealt (e.g., that the community cards will form a winning poker combination (poker-type bet) or that the first and last community cards dealt will be jokers (Wild Viking bet)). A gaming layout is also disclosed and includes a plurality of betting positions that correspond to the predetermined set of cards, the poker type bets, and other types of possible bets.

8 Claims, 4 Drawing Sheets

WILD VIKING ROULETTE

FIELD OF THE INVENTION

The present invention generally relates to a method and apparatus for playing a casino game. More particularly, the present invention relates to a modified roulette game that may be played as a casino table game or as a video or Internet game.

BACKGROUND

Roulette is a popular gambling game offered in many casinos around the world. American Roulette is a table game played with a dealer, or croupier, and a wheel with 38 equal-sized slots. Each of the 38 slots has a number and a color associated with it and printed in the slot. Two slots are given the numbers "0" and "00" and are colored green; these slots are at opposite ends of the wheel. In between the green numbers are 36 other slots (numbered one through 36), which alternate between 18 red slots and 18 black slots. In a common variation, the numbers 2, 4, 6, 8, 10, 11, 13, 15, 17, 20, 22, 24, 26, 28, 29, 31, 33, and 35 are colored black; the numbers 1, 3, 5, 7, 9, 12, 14, 16, 18, 19, 21, 23, 25, 27, 30, 32, 34, and 36 are colored red.

Upon play, the dealer spins the wheel in one direction and rolls a small metal ball in the other direction. When the wheel slows down, the ball settles into one of the numbered and colored slots. This number/color combination is the winner.

There are a variety of bets that may be made in a traditional roulette game. There is a table that players may place wagering chips on, and the values on this table correspond with the values imprinted in the 38 slots of the roulette wheel. This table customarily contains three columns of 12 numbers each, numbered from one through 36. Thus, the numbers 1, 2, and 3 are in the first row, numbers 4, 5, and 6 are in the second row, and so on. Each number is colored the same color that it is on the roulette wheel. Above these numbers are usually places for the "0" and "00" green numbers.

There are a variety of "inside bets" that may be played on the number grid (which contains numbers "0," "00," and 1-36). A player may bet on any one individual number coming up on the spin of the wheel by placing a wagering chip on that particular number on the gaming table; this often pays 35:1. By placing the chips in between two numbers, on a row of three numbers, on a diagonal corner in between four numbers, or between two rows, players can also bet on two, three, four, or six adjacent numbers at once. A bet on two numbers (known as a "split bet") usually pays 17:1. A bet on one row of three numbers (known as a "street bet" or "three number bet") usually pays 11:1. A bet on a cluster of four numbers (known as a "corner bet" or "square bet") usually pays 8:1. A bet on two rows of six numbers total (known as a "six-line bet") customarily pays 6:1.

To the side and bottom of the grid of numbers are usually other "outside bets" (bets on the grid of numbers itself are known as "inside bets"). These outside bets often include spaces where players may place chips in order to bet on red or black numbers, even or odd numbers, one column of numbers (e.g., 1, 4, 7, 10, 13, 16, 19, 22, 25, 28, 31, and 34), a group of numbers (1-12, 13-24, 25-36, 1-18, or 19-36), and possibly other variations. Each of these outside bets offers a payout related to the odds against it hitting (for example, the red or black bets usually pay 1:1, as do the even or odd bets; the column bets pay 2:1, and the groups of numbers pay either 2:1 on groups of 12 numbers or 1:1 on groups of 18 numbers).

The standard game of roulette, while popular, could be improved in a number of ways. First of all, the arrangement and colors of the numbers is simple and uninteresting. Judging by the immense popularity of card games (those using a standard 54-card deck of four different suits plus two jokers), players like the additional variation of thirteen different values of cards in four different suits (plus two "jokers"). Roulette could be improved, made more interesting, and given additional and varied types of new bets by increasing the number of slots on the roulette wheel (and hence, on the matching betting table), by increasing the amount of numbers, colors/suits, or both. As conceived by the inventors of the present invention, roulette may also be played without a roulette wheel at all; instead, cards could be manually dealt or turned over, or selected by automated means on a computer screen. As discovered by the inventors, a roulette game using 54 values (52 cards plus two "joker" values) of five different suits (including jokers) can lead to many more and more interesting bets than can a conventional roulette game using only 38 values (36 plus the "0" and "00" values) of three different colors. For example, as the inventors will show in the ensuing description, while traditional roulette allows players to bet on "red" or "black," their advanced variation of roulette utilizing 52 card-based values would allow the player to bet on "spades," "diamonds," "clubs," or "hearts;" and the player would still be able to bet on "red" or "black" cards, if he so desired.

Additionally, standard roulette games use a single spin of the wheel and therefore a single selected value to determine the outcome of all bets made in a given betting round. Roulette could be made far more interesting and build more suspense for players with the addition of multiple selected values per betting round instead of a single one. The combinations of spins that could produce a winning hand would be vastly increased, and the game would be made more interesting to players.

Another flaw of roulette is that it does not offer the possibility of "side bets," and the commensurately high pots that may be won in a high-odds, high-payout side bet. The addition of a "side bet" and additional ways to win (regardless of the number that is selected by the spinning of the roulette wheel) offers the possibility and excitement of two games in one—even if a player loses the main bet, he may still be able to win the side bet (or bets). Additionally, the most that a player can win by picking an individual number in conventional roulette is 35:1. However, as conceived by the inventors of the present invention, the game could be improved and made more exciting to players and more profitable to casinos by introducing side bets that may pay 50:1, 1,000:1, 10,000:1, or even a progressive jackpot. The addition of such variations would likely make roulette more fun and exciting for players, as it increases the unpredictability of roulette, allows for the player to bet on two different types of games at once, and increases the payouts that a player may receive.

Further, as mentioned above, card games in general, and poker in particular, are very popular in America and around the world. Poker especially has benefited from a recent popularity explosion due to high-stakes tournaments being played that receive enormous national television coverage. There are many different poker tournaments, celebrity poker games, poker tutorials, and other poker-related shows on television; there are also countless poker-related sites on the Internet, where players may learn the rules of poker, be shown various strategies for playing poker, and even wager on poker games. Even laptop computers, personal digital assistants, and cell phones offer poker games for players on the go. The game is so popular, several airlines now offer poker games on television screens embedded in each seat wherein players on a flight may compete against other players on that flight. If traditional roulette could tap into the popularity of poker, poker cards, and the rankings and odds of poker hands, it could be greatly improved. An improvement of roulette that offered the number-based betting of a roulette-like table layout and/or roulette-like wheel, concurrently with the use of playing cards and the five-card poker-hand-based betting of poker and poker games would be ideal.

Thus, there is a need in the art for a modified roulette game which addresses the drawbacks of traditional roulette described above. Variations such as those conceived by the inventors as introduced above and will be described in the following discussion are therefore likely to increase the popularity of roulette even further. Roulette games utilizing such variations and advantages are likely to be more popular than standard roulette games, attract more and higher wagers from bettors, be more enjoyed by players, and be more profitable for the casinos that offer them. Other advantages of the present invention will be apparent to one of ordinary skill in the art in light of the ensuing description of the present invention.

SUMMARY OF THE INVENTION

The present invention is directed to a method of playing a modified roulette game that generates additional excitement, player control, and more revenue for both players and casinos than conventional roulette. The present invention includes more potential selected values (54 versus only 38), more colors or "suits" (five versus three), more ways to win (through both roulette-type and poker-type bets), and more varied types of bets and side bets that may be made. The present invention also provides additional betting opportunities and an opportunity for larger payouts than conventional roulette games. Providing players with more opportunities to win and the opportunity for bigger payouts would certainly bring excitement and interest to players and will likely attract new players to the game.

To achieve the foregoing and in accordance with the purposes of the present invention, the present invention is directed to a gaming method that comprises: a dealer shuffling a predetermined set of cards; each player placing one or more bets by placing wagers on designated betting areas of a gaming layout; dealing a plurality of community cards onto the playing table to be used communally by all players; the dealer revealing the values of the community cards; the dealer using a predetermined card to determine the result of all "roulette-type" bets; and the dealer resolving all bets according to payout schedules roughly corresponding to the odds of each event happening. The gaming method may further comprise allowing each player to make one or more optional side bets based on the outcome of two or more of the community cards.

One embodiment of the present invention is directed to a method of playing a modified roulette game comprising: (a) requiring each player to make at least one bet to participate in the game; (b) dealing five community cards face down from a standard 54-card deck (including two jokers); (c) revealing the five community cards dealt; (d) using the fifth community card dealt to determine the outcome of roulette-type bets by comparing the fifth community card value with the roulette-type bets placed by the players; and (e) resolving all bets. In step (a) the player may make one or more roulette-type bets (based on the outcome of the fifth community card dealt) and one or more optional side bets based on the outcome of two or more of the community cards. For example, a player may make a side bet that the five community cards dealt will form a winning five-card poker hand (poker-type bet) or that both the first and fifth community cards dealt will be jokers (Wild Viking bet).

Another aspect of the present invention is directed to a gaming layout which includes a plurality of community card positions and a wagering area comprised of multiple betting positions that represent the various types of bets that the player can make. For example, a gaming layout of one embodiment would comprise of betting positions that correspond to the following types of bets: any single card, any two adjoining specific cards, any four specific adjoining cards, any number, any adjoining pair of numbers, any particular suit, any particular block of four numbers, any particular block of six numbers, red/black, even/odd, Wild Viking bet, poker bet, and progressive jackpot bet.

The markings on the gaming layout would correspond to those available in a standard 54-card deck of playing cards (including two jokers). These markings would be arranged in rows and columns to easily facilitate betting on groups; for example, bets on any value (such as "any King"), or any suit (such as "spades") could be made by placing a bet on an entire column or row of similar values. Players could also bet on several numbers at once through the use of various traditional roulette-type wagers, such as split bets, two-number-bets, four-number bets, or eight-number bets (as described above).

Additionally, there could be places on the gaming table to allow for bets on either or both joker values, on even or odd numbers, on different colored numbers (for example, red or black), on a range of values (for example, between ten and King, inclusive), or on a subset of the entire range of values available (for example, greater than seven). Further, there could be places on the gaming layout to allow for side bets on the result of a five-card poker hand that is selected through some combination of playing cards (manual or electronic) and possibly a spin of a modified roulette wheel. Such wagers would bet on the composition and ranking of the five-card poker hand produced. These bets would pay varying amounts based on the rarity of each poker hand appearing, and would wager for the occurrence of poker hands such as one pair, Jacks or better, two pairs, three of a kind, straight, flush, full house, four of a kind, straight flush, Royal Flush, or five of a kind. Additional wagers and payouts could be based on special occurrences, such as the presence of a joker in a certain position (for example, a joker appearing as the first and/or last of the five card values selected).

The above description sets forth a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in further detail, it is to be understood that the invention is not limited in its application to the details of the construction and to the arrangement of the components set forth in the following description or as illustrated in the drawings. The invention is capable of other embodiments and of being practiced and carried out in various ways. Furthermore, it is to be understood that the phraseology and terminology employed herein are for the purpose of description and should not be regarded as limiting.

Other features, aspects and advantages of the present invention will become apparent from the following description of the invention, taken in conjunction with the accompanying drawings, which illustrate, by way of example, various features of embodiments of the invention.

DETAILED DESCRIPTION OF THE INVENTION

In the following description of embodiments of the invention, reference is made to the accompanying drawings, which form a part of this application. The drawings show, by way of illustration, specific embodiments in which the invention may be practiced. It is to be understood that other embodiments may be utilized and modifications may be made without departing from the scope of the present invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It further will be understood by those of ordinary skill in the art that some steps may be omitted or added and still fall within the spirit of the invention.

Gaming Method

The present invention comprises a gaming method and an apparatus that may be used to implement the gaming method. In general, the gaming method is designed to reward players (by allowing them to win and get paid for various bets) if they correctly select the outcome of a certain card revealed, a combination of cards revealed, and/or spins of a modified roulette wheel or roulette-like gaming wheel.

The cards used are those from a standard 54-card deck of playing cards, consisting of four Aces, twos, threes, fours, fives, sixes, sevens, eights, nines, tens, Jacks, Queens, and Kings; one of each value is also denominated with suits of spades, diamonds, clubs, and hearts. In other words, there are four sets (of thirteen cards each) of each numerical or letter value. Additionally, there are two distinct jokers (for example, one "red joker" and one "black joker"). Either a single deck or a "shoe" of multiple decks may be used.

In embodiments including a roulette-type wheel, the wheel is modified to have 54 slots, each of which is marked to coincide with the 54 different markings in a traditional deck of playing cards. Usually, the wheel is spun in one direction and a small metal ball is spun in the other direction until the ball settles into one of the 54 slots or grooves; the marking on that groove determines the card value selected.

In either case, the playing card deck or roulette-like wheel may be replaced by computer-generated representations in various embodiments. Similar to computer poker games, the values may be selected randomly by computer and displayed as a virtual representation on a computer or television screen, transmitted across the Internet, or replicated as a series of lights or colors. Those of ordinary skill in the art will be easily able to adapt the present invention to various electronic and Internet-enabled forms.

Figure 3:
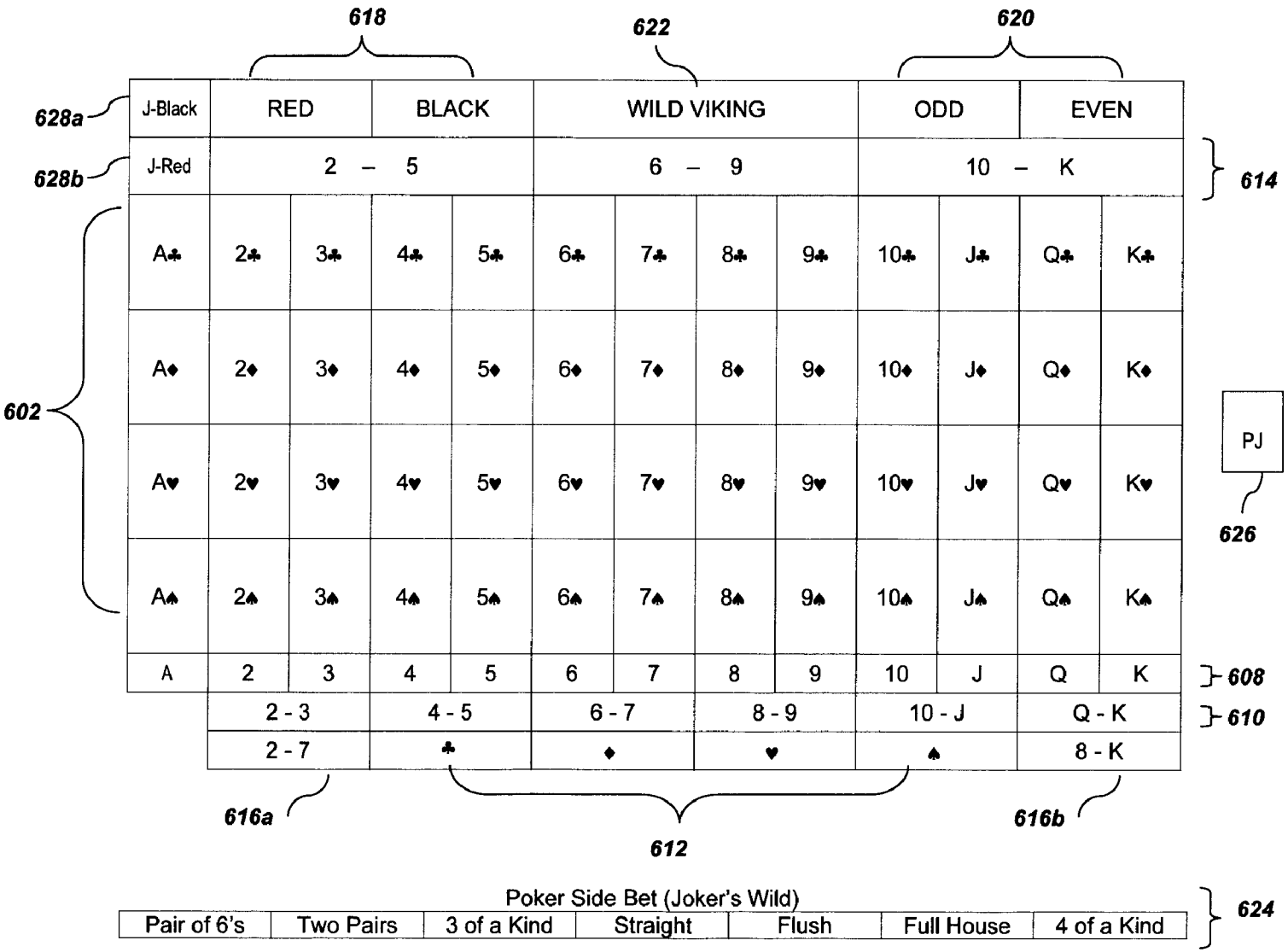
FIG. 3 depicts a top plan view of a wagering area of a gaming layout in accordance with an embodiment of the present invention.

Before play, players may bet by placing bets on a wagering area on a gaming table. The wagering area includes a plurality of betting positions representing various bets that the player can make. The betting positions may be comprised of a plurality of boxes representing the 54 possible card values and other boxes representing various other types of bets (as seen in FIG. 3). As depicted in FIG. 3, in one embodiment of the invention, betting position 602 is comprised of a grid composed of four rows of 13 columns each, with the Ace of clubs, Ace of diamonds, Ace of hearts, and Ace of spades from top to bottom along the first (leftmost) column, the two of clubs, two of diamonds, two of hearts, and two of spades in the next column, the three of clubs, three of diamonds, three of hearts, and three of spades in the next column, and so on. Additional betting areas may be positioned above, below, or to the sides of betting position 602. Gaming chips are placed in particular places corresponding to particular bets. For example, a player may place a gaming chip inside a box containing a representation of the King of spades; the player will win a certain multiple of his original bet if the King of spades is selected through the methods described below. Players may also bet on various combination bets, such as any King, any spade, any black card, cards above a seven, or on two-number, four-number, or eight-number bets on values arranged near each other on the gaming board.

Additionally, players have the option of betting on side bets that are paid in accordance with rankings and rules of traditional five-card poker hands. For example, players can bet that the five values selected will result in a poker hand comprised of one pair, Jacks or better, two pairs, three of a kind, straight, flush, full house, four of a kind, straight flush, Royal Flush, or five of a kind. Additional wagers and payouts could be based on special occurrences, such as the presence of a joker in a certain position (for example, a joker appearing as the first and/or last of the five card values selected). These bets would be paid out in accordance with the rarity of the hands, as described in the tables below.

Once all bets have been placed on the gaming table (along with any side bets, if any), a plurality of values are determined by the dealer or "house" (or by computer simulation, in the case of electronic embodiments). For example, in one embodiment of the invention, a total of five values are determined. Some number of the five values are determined by drawing and flipping over cards from a standard 54-card deck of playing cards (or multiple decks shuffled together, or computer simulation thereof). In alternate embodiments of the invention, the remainder of the five values (if any) are selected by spinning a modified roulette wheel as described above. In one embodiment, five cards may be flipped over (without the use of a modified roulette wheel); in another embodiment, the modified roulette wheel may be spun five times; in yet another embodiment, four cards may be flipped and the fifth value may be determined by use of the modified roulette wheel.

Once all five values are determined, the "roulette-type" bets (described above as "inside bets" or "outside bets" on values or groups of values that must match only a single value determined by the dealer) are compared to the bets placed by players on the gaming board. In one embodiment, a predetermined value such as the fifth value selected (and only that value) is used to determine the payouts for each roulette-type bet. In alternate embodiments, only the first, second, third, or fourth determined value could be used; however, in all cases, the roulette-type bets are evaluated based on only a single determined value. These bets are then paid out, often in some multiple according to the rarity of the event predicted by the wager.

After the determination of the five values, and either before, after, or concurrently with payouts for the roulette-type bets, the "poker-type" bets (described above as bets on the rankings of five-card poker hands such as three of a kind or a flush) are compared to all five values that were selected. Winners of these poker-type bets are then also paid out, often in some multiples based on the rarity (and rank) of the five-card poker hand that was achieved.

Figure 1:
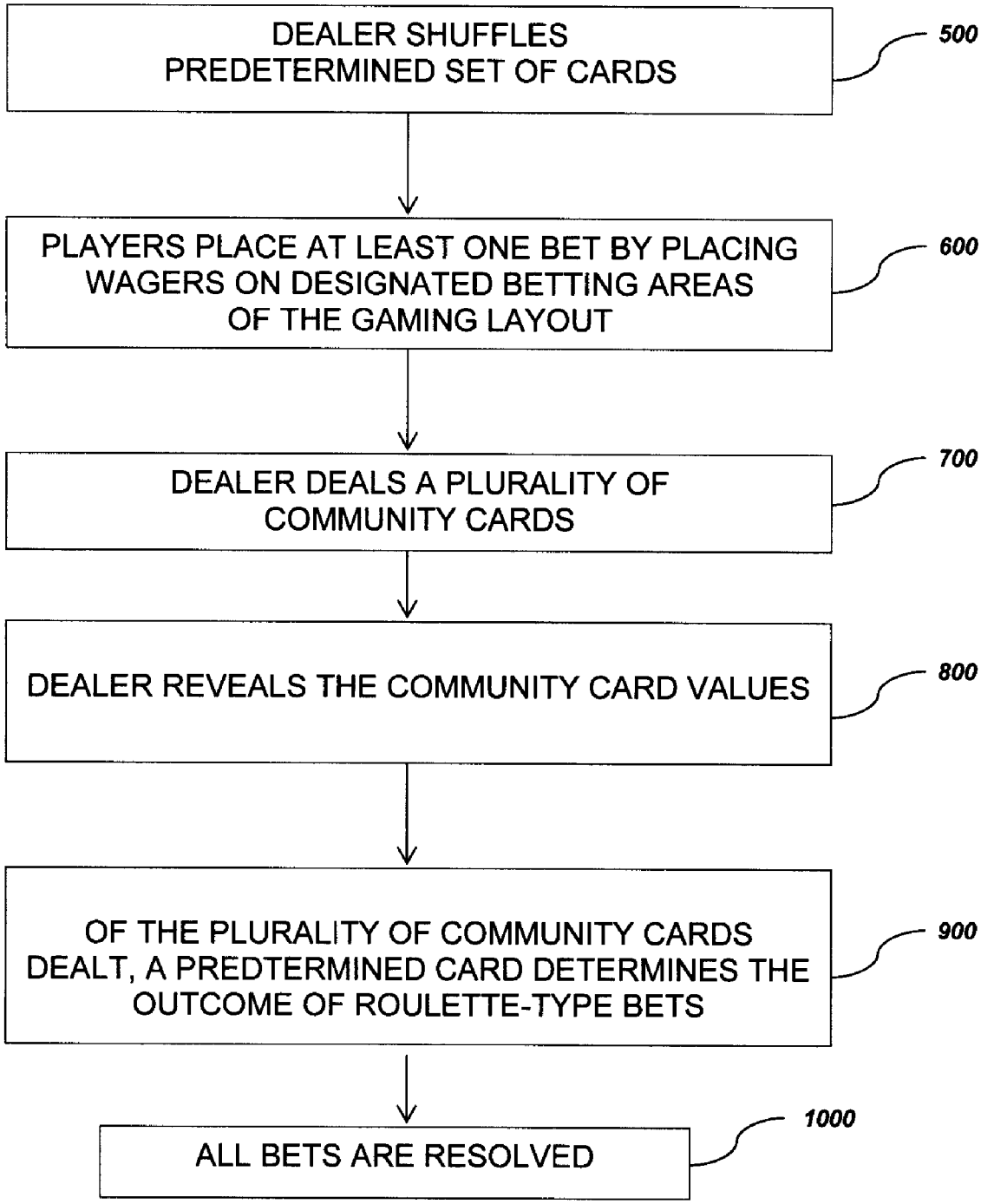
FIG. 1 depicts a block diagram showing generally the steps of a gaming method in accordance with an embodiment of the present invention.

As depicted in the block diagram of FIG. 1, the gaming method of the present invention comprises: a dealer shuffling a predetermined set of cards (block 500); each player placing one or more bets by placing wagers on designated betting areas of the gaming layout (block 600); the dealer dealing a plurality of community cards from the predetermined set of cards (block 700); the dealer revealing the values of the community cards (block 800); the dealer using a predetermined card (out of the community cards dealt) to determine the outcome of "roulette-type" bets (block 900); and the dealer resolving all bets according to a payout schedule roughly corresponding to the odds of each event happening (block 1000).

In an alternate variation of the embodiment depicted in FIG. 1, the gaming method may further comprise using a roulette-like gaming wheel (modified to have a certain number of slots, each of which is marked to coincide with the different indicia in the predetermined set of cards) in combination with or as a substitute to designate one or more of the card values selected. Also, in further embodiments, each player may also place an optional side bet based on any occurrence. For example, a player may make a side bet that the cards drawn will form a winning poker hand. In such embodiments, these "poker-type" bets rely on all of (or a plurality of) the card values drawn and the ranking of the poker hand that they form.

Figure 2:
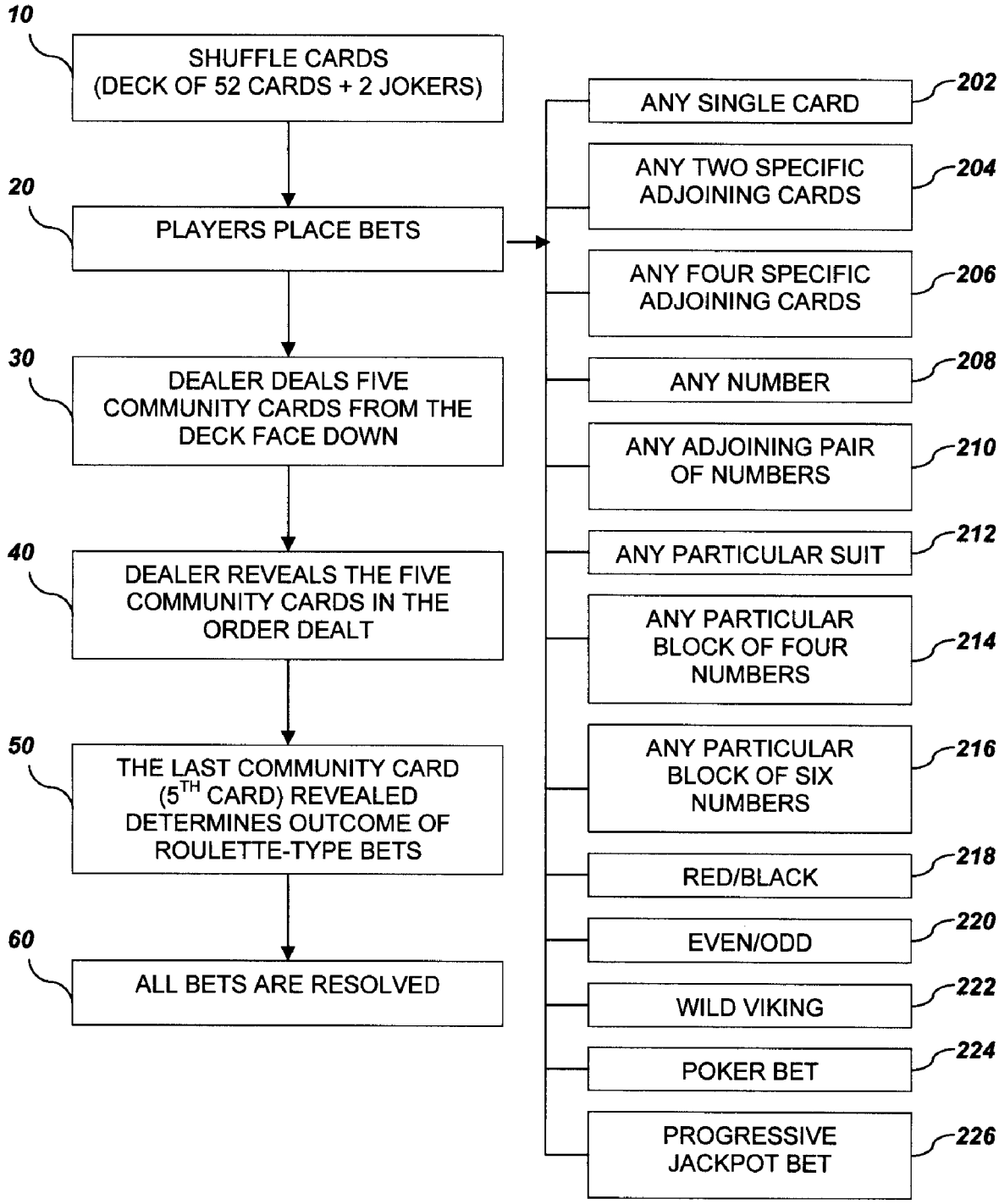
FIG. 2 depicts a flowchart showing a sequence of steps of a gaming method in accordance with an embodiment of the present invention.

Referring now to FIG. 2, in one embodiment of the present invention, the gaming method of the invention comprises: the dealer shuffles a set of predetermined cards (step 10); players place their bets (step 20); the dealer deals five community cards from the deck face down (step 30); the dealer reveals the five community cards in the order dealt (step 40); the last community card revealed determines the outcome of all "roulette-type" bets; and all bets are resolved (step 60). The ensuing discussion will now describe steps 10-60 and variations thereof in greater detail.

Predetermined Set of Cards

The gaming method of the invention begins with a dealer shuffling a set of predetermined cards (step 10). In the embodiment of the invention depicted in FIG. 2, the predetermined set of cards is comprised of a standard 54-card deck of playing cards, which includes four Aces, twos, threes, fours, fives, sixes, sevens, eights, nines, tens, Jacks, Queens, and Kings; one of each value is also denominated with suits of spades, diamonds, clubs, and hearts; and two distinct jokers (i.e., one "red joker" and one "black joker").

Although, the embodiment depicted utilizes all 54 cards of a standard deck of playing cards, additional playing cards may be added or removed from the set of cards, and specialized cards with custom indicia may be used instead of or in combination with standard playing cards so long as the betting positions of the wagering area correlate with the set of cards chosen for any given embodiment. Also, in alternate embodiments, a single deck or up to eight or more decks of predetermined cards may be used. Additionally, in electronic embodiments, virtual "cards" may be used and card values may be selected randomly by computer.

Types of Bets

In step 20, the players are then asked to place their bets on a wagering area of a gaming table (see FIG. 3 for top plan view of a wagering area) before any cards are revealed. A player is required to make at least one bet to participate in the game. As illustrated in FIG. 2, during step 20, the players may make any one or any combination of the following types of bets: any single card (step 202), any two adjoining specific cards (step 204), any four specific adjoining cards (step 206), any number (step 208), any adjoining pair of numbers (step 210), any particular suit (step 212), any particular block of four numbers (step 214), any particular block of six numbers (step 216), red/black (step 218), even/odd (step 220), Wild Viking (step 222), poker bet (step 224), and progressive jackpot bet (step 226).

A. Roulette-Type Bets

Figure 3A:
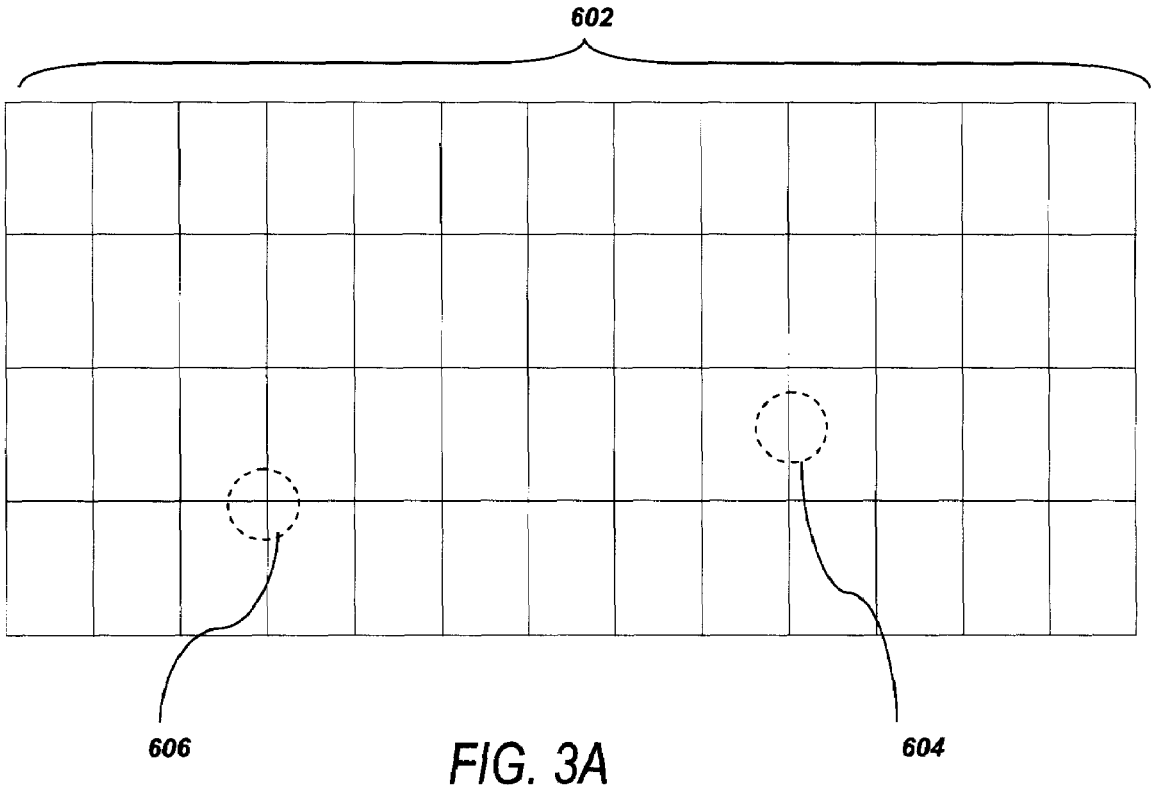
FIG. 3A is an enlarged view of a portion of the betting positions depicted in FIG. 3 showing how two-card bets and four-card bets are made in accordance with an embodiment of the present invention.

The above-identified bets include "roulette-type" bets of varying amounts, including "inside bets" and "outside bets." With reference to FIGS. 2, 3, and 3A, inside bets are placed inside squares containing individual values on the gaming table as for example, inside the box depicting the King of spades (step 202; FIG. 3, position 602), or on the jokers (step 202; positions 628*a* or 628*b*), on lines between two specific adjoining card values (step 204; FIG. 3A, position 604), or on corners between four specific adjoining card values (step 206; FIG. 3A, position 606).

Outside bets are played on other squares around the 52-card-value table grid (FIG. 3, position 602), and may be played on any individual number such as a "seven" (step 208; position 608), on any adjoining pair of numbers such as "10-J" (step 210; position 610), on any particular suit such as "spades" (step 212; position 612), on any particular block of four numbers such as "6-9" (step 214; position 614), on any particular block of six numbers such as "8-K" (step 216; position 616*a* or 616*b*), on red or black (step 218; position 618), or on even or odd (step 220; position 620). Both inside bets and outside bets are commonly used roulette bets and are understood by those skilled in the art.

B. Poker Side Bets

In some embodiments of the present invention, the bets may further comprise of one or more optional side wagers or progressive jackpot wagers, known as "poker-type" bets; these include the Wild Viking Bet (step 222; position 622), the Poker Side Bet (step 224; position 624); and the Progressive Jackpot Poker Bet (step 226; position 626). Each of the poker-type bets relies on the result of more than a single card value.

In such embodiments, in addition to any "roulette-type" bets that may be placed (described above as "inside bets" or "outside bets" on values or groups of values that are matched to, and dependent upon, only a single value determined by the dealer), a separate "poker-type" bet (described above as bets on the rankings of five-card poker hands such as two pairs or a flush) may also be placed before the determination of the five values. This side bet would likely be made in step 20 of FIG. 2.

Such side bets may be made for the occurrences of a variety of events. For instance, in one embodiment of the invention, a player may make a side bet that their five-card poker hand will be comprised of one of the following winning combinations:

TABLE 1

| Bet | Pay (to 1) |
|---|---|
| Four of a Kind or Better | 280 |
| Full House or Better | 150 |
| Flush or Better | 90 |
| Straight or Better | 45 |
| Three of a Kind or Better | 9 |
| Two Pairs or Better | 6 |
| A Pair of 6s or Better | 1 |

In TABLE 1, all five determined values are used to form a five-card poker hand that is evaluated according to the rules of poker. Jokers are "wild" (may be used as any of the 52 other playing card values) and are used by the house to make the best (highest ranking) poker hand possible. Each of the above bets is a separate bet (and players may bet on any or all of them) that pays the odds shown. For example, a bet on "Two Pairs or Better" wins six to one even if the five-card poker hand formed is a flush.

Various embodiments of the invention may use different payout amounts (five to one instead of six to one) and/or different levels of bets (bets on a straight flush or better, or on one pair of Jacks or better, for example). In addition, the poker hand may be comprised of a different amount of cards. For example, in embodiments wherein the plurality of cards drawn involve drawing 3 or 7 cards, then these embodiments may provide an optional side bet based on 3-card poker hands or 7-card poker hands.

C. Progressive Jackpot Side Bets

In alternate embodiments of the invention, either concurrently with or without the side bets listed above and below, a progressive jackpot side bet may be offered to players. A progressive jackpot is one that grows based on the bets played until a player or player wins the jackpot, at which point the jackpot is reduced back to some starting level and begins growing again as additional bets are played.

In one embodiment of the invention, the progressive jackpot bet will be fixed at one dollar. The player will win if the five-card poker hand determined (as described above) is three of a kind or better. A determined percentage of each bet will go into the progressive jackpot (and be reflected on the progressive jackpot meter) to increase it. Players will be paid out according to the rarity of the poker hand created. If the poker hand created is a "Wild Viking Royal Flush," then the player wins the jackpot (in the case of two or more players winning, the jackpot may be split) and is paid out the current amount of the progressive jackpot (the progressive jackpot is then re-set at a predetermined level, for example $10,000, and begins to grow again). A Wild Viking Royal Flush may be defined, for example, as a five-card hand where both the first and fifth value selected are jokers, and where all five cards together can form a Royal Flush (for example, a hand of joker, Queen of spades, ten of spades, Ace of spades, joker would qualify). The payout schedule in one embodiment may follow the table below.

TABLE 2

| Hand Type | Pay (to 1) |
|---|---|
| Wild Viking Royal Flush | Progressive Jackpot |
| Five of a Kind | 1,000 |
| Royal Flush | 250 |
| Straight Flush | 50 |
| Four of a Kind | 20 |
| Full House | 10 |

TABLE 2-continued

| Hand Type | Pay (to 1) |
|---|---|
| Flush | 8 |
| Straight | 5 |
| Three of a Kind | 3 |

D. Additional Side Bets

Other side bets may also be played based on various combinations of two or more of the five values selected. In one embodiment, a "Wild Viking" side bet may be made that wins (and pays out a multiple of the amount wagered, for example 1250:1) if both the first value selected and the fifth value selected are jokers. Additional embodiments may use some additional combination of the five selected values to create new and exciting bets that are not available in traditional roulette. Due to the fact that 54 (instead of 38 in traditional roulette) possible values are used, and that five of these values are selected for each round of play (as opposed to just one value in traditional roulette), the number and value of additional side bets in various embodiments of the present invention are too numerous to list.

Selection and Revelation of Values

Figure 4:
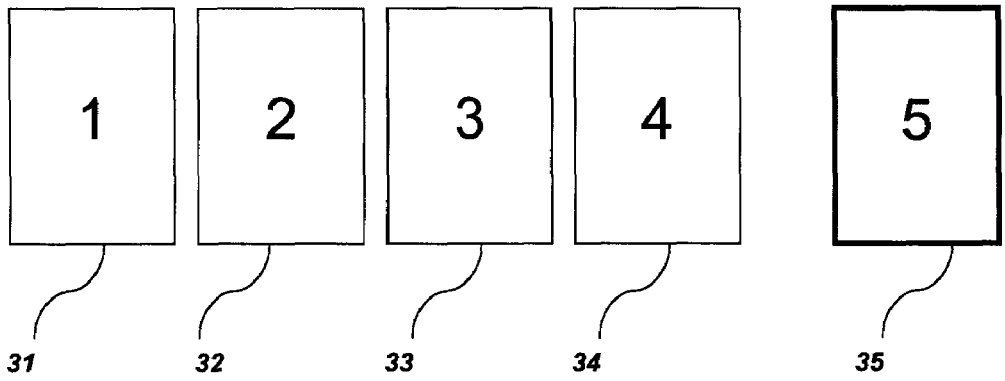
FIG. 4 depicts community card positions of a gaming layout in accordance with an embodiment of the present invention.

Still referring to FIG. 2, after the dealer shuffles the cards and the players have placed any one or combination of the above-described bets, the dealer deals five community cards from the deck or decks (step 30) and places them face down in a designated community card are on the gaming table (FIG. 4, community card positions 31-35). The dealer places the first community card dealt face down on card position 31, and then places the second community card face down on position 32, the third community card face down on position 33, the fourth community card face down on position 34, and the fifth and final community card face down on position 35. In alternate embodiments, only four or fewer community cards are dealt and one or more of the five community card values (for example, the last one) are instead selected by use of a modified roulette wheel with 54 slots corresponding to the 54 values in the deck of cards. In electronic embodiments, the card values are randomly selected and displayed by computer or electronic means.

The dealer then reveals (by flipping over) the five cards in the order they were dealt (step 40). The dealer first flips over and reveals the first community card in position 31, then the second community card in position 32, the third community card in position 33, the fourth community card in position 34, and finally the fifth and last community card in position 35.

The last community card revealed (the fifth card drawn or rolled on the modified roulette wheel) determines the outcome of all roulette-type bets (step 50). Note that "poker-type" bets rely on all five of the community cards and the ranking of the poker hand that they form. Therefore, the last community card value, along with the first four, also determines the outcome of the poker-type bets. In alternate embodiments, instead of the last community card dealt, the predetermined value used to resolve the roulette-type bets may be either the first, second, third, fourth, or any other value designated.

Resolving Bets

Once all five cards are revealed, the dealer resolves each bet in accordance with the rules described herein (step 60). The roulette-type bets are then either collected or paid based on the result of the fifth card drawn or spun on the modified roulette wheel, and payouts are based on the odds of each event occurring. The following is an example of a payout schedule to settle roulette-type bets:

TABLE 3

| Bet Type | Pay (to 1) |
|---|---|
| Any single card | 51 |
| Any two specific adjoining cards | 25 |
| Any four specific adjoining cards | 12 |
| Any number (A, 2, 3, 4, 5, 6, 7, 8, 9, 10, J, Q, or K) | 12 |
| Any adjoining pair of numbers (2-3, 4-5, 6-7, 8-9, 10-11, or 12-13) | 5 |
| Any particular suit | 3 |
| Any particular block of 4 numbers (2-5, 6-9, or 10-13) | 2 |
| Any particular block of 6 numbers (2-7 or 8-13) | 1 |
| Red/Black | 1 |
| Even/Odd (If Ace is drawn, player loses bet) | 1 |

The poker-type bets are paid based on the results of all five cards drawn and the resulting five-card poker hand that is revealed. The general method of payouts and odds are understood by those reasonably skilled in the art. Example of payout schedules to resolve poker side bets and progressive jackpot bets are depicted in TABLES 1 and 2 respectively.

In alternate embodiments of the invention, the payout schedules for either the roulette-type or poker-type bets may be of varying amounts, but usually relate to the odds of each wagered event occurring and usually include a measure of profit for the casino or "house." In electronic embodiments, the sequence of play may be replicated by electronic means. In some Internet-enabled embodiments, players will be able to play from their home computers by connecting to a web server that approximates the actions of the dealer and randomly selects card values.

Gaming Layout

Referring now to FIG. 3, a wagering area of a gaming layout in accordance with an embodiment of the present invention is shown. The overall gaming layout may be made with the common shapes of conventional casino gaming tables such as a semi-circular, oval, or rectangular shape. Gaming layout may also be made with materials of conventional gaming tables, such as felt, vinyl, wood, plastic, laminate, and/or marble. In alternate embodiments of the present invention, the gaming layout may be a video or computer representation of a conventional gaming table.

The gaming layout includes a plurality of community card positions 31-35 which are distinct from each other, are separated by lines, design, and/or spacing between the positions, and are individually adapted to identify each community card distributed during the course of the game. As depicted in FIG. 4, positions 31, 32, 33, 34, and 35 include the indicia "1", "2", "3", "4", and "5" respectively to designate that the first, second, third, fourth, and fifth community cards should be placed thereon, respectively. Further, position 35 may include additional designation and/or is further adapted to be distinct from the other community cards to indicate that the fifth community card must be used to resolve the roulette-type bets. For example, in the embodiment depicted in FIG. 4, position 35 includes a bolder and thicker border and is spaced apart from the other group of community cards to designate that the community card that is to be placed on position 35 is to be used to resolve the roulette-type bets.

Additionally, the gaming layout will be surrounded by a plurality of player positions. Each player's bets may be distinguished by the use of different color betting chips, as is customary in the art. Any suitable number of player positions may be included in a gaming layout of the present invention. The number of player positions may vary depending on the size of the gaming table and the number of players a casino wishes to accommodate in one given game. Also, it is not necessary that all player positions be utilized while the game is being played. At least one player position is needed to be utilized for the game to be played.

Near the wagering area would also be an area where the dealer may store gaming chips, place card decks, potentially utilize a nearby roulette-like wheel, and place the community cards dealt. The wagering area is situated within the gaming layout in an area of the gaming table accessible to both the dealer and all players. The wagering area includes a plurality of betting positions representing various bets that the player can make. The wagering area of the gaming layout includes the following betting positions summarized in TABLE 4:

TABLE 4

| Bet Type | Betting Position (FIGS. 3-3A) |
|---|---|
| Any single card | 602 |
| Single Card (Joker) | 628a, 628b |
| An two specific adjoining cards | 604 |
| Any four specific adjoining cards | 606 |
| Any number (A, 2, 3, 4, 5, 6, 7, 8, 9, 10, J, Q, or K) | 608 |
| Any adjoining pair of numbers (2-3, 4-5, 6-7, 8-9, 10-11, or 12-13) | 610 |
| Any particular suit | 612 |
| Any particular block of 4 numbers (2-5, 6-9, or 10-13) | 614 |
| Any particular block of 6 numbers (2-7 or 8-13) | 616a, 616b |
| Red/Black | 618 |
| Even/Odd | 620 |
| Wild Viking (Both $1^{st}$ and $5^{th}$ cards are Jokers) | 622 |
| Poker Side Bet (Pair of 6's, Two Pairs, 3 of a Kind, Straight, Flush, Full House, or 4 of a Kind) | 624 |
| Progressive Jackpot | 626 |

As discussed herein, each betting position may be comprised of a plurality of boxes representing various types of bets. For instance, betting position 602 is comprised of a grid wherein each box of the grid represents 52 possible card values. This grid is comprised of four rows of 13 columns each, with the Ace of clubs, Ace of diamonds, Ace of hearts, and Ace of spades from top to bottom along the first (leftmost) column, the two of clubs, two of diamonds, two of hearts, and two of spades in the next column, the three of clubs, three of diamonds, three of hearts, and three of spades in the next column, and so on. Additionally, Positions **628*a* and 628*b* represent the black joker card and red joker card respectively. Essentially, position 602 is a grid of rows and columns where the "inside bets" are played (positions 602, 604, and 606). Adjoining or nearby are boxes or spaces for various "outside bets" (positions 608, 610, 612, 614, 616, and 618) (together, the inside bets and outside bets comprise the "roulette-type bets" as described above), as well as spaces to place poker-type wagers or side bets, as described above (positions 622, 624, and 626**). Often, the payout table or tables for various side bets will be included on the gaming surface or on nearby signage.

In alternate embodiments of the invention, a different table layout may be used that still allows for various roulette-type and poker-type bets (for example, various boxes may be larger, smaller, or placed in different positions relative to each other, betting positions may include different shapes such as circles or ovals, etc.,). Also, in electronic embodiments, the gaming layout may be projected on a screen or monitor. Of course, the number, locations, and designs of the player's betting positions, the community card positions, and/or roulette-type wheel may be adjusted as desired so long as they remain within reasonable access and visibility for the players and the dealer. As such, the arrangement of the card values used in the gaming layout may be arranged in various orders (e.g., descending order from left to right, card values grouped by color of suits, etc.,) so long as the card values are easily found by the players and dealer. Also, any label, symbols, characters, and/or logos may be included within the betting positions and/or community card positions so long as the meaning of the designation is clear to the players and dealer. Other features may be included within the gaming layout such as payout schedules/tables, rules of play, logos, trademarks, casino name, and/or design or artistic elements. Thus, the gaming layout is not limited to the arrangement depicted in the figures herein and could vary without departing from the scope of the invention.

EXAMPLES

The following mathematical analysis for the following example of the above-described embodiments was conducted by Gambology of Las Vegas, Nev. A computer program was developed to compute the probability distribution and the house advantage.

Roulette Type of Bets

Any single card:

The probability that the card will be drawn is 1/54. The house edge is 1−(1/54×(51+1))=2/54=3.70%.

Any two specific adjoining cards:

The probability that either of the cards will be drawn is 2/54. The house edge is 1−(2/54×(25+1))=2/54=3.70%.

Any four specific adjoining cards (corners):

The probability that any of the 4 cards will be drawn is 4/54. The house edge is 1−(4/54×(12+1))=2/54=3.70%.

Any number:

The probability that the number will be drawn is 4/54. The house edge is 1−(4/54×(12+1))=2/54=3.70%.

Any adjoining pair of numbers:

The probability that either of the numbers will be drawn is 8/54. The house edge is 1−(8/54×(5+1))=6/54=11.11%.

Any particular suit:

The probability that the particular suit will be drawn is 13/54. The house edge is 1−(13/54×(3+1))=2/54=3.70%.

Any particular block of 4 numbers:

The probability that any of the 4 numbers will be drawn is 16/54. The house edge is 1−(16/54×(2+1))=6/54=11.11%.

Any particular block of 6 numbers:

The probability that any of the 6 numbers will be drawn is 24/54. The house edge is 1−(24/54×(1+1))=6/54=11.11%.

Red/Black:

The probability that the color of the $5^{th}$ card matches the player's pick is 26/54. The house edge is 1−(26/54×(1+1))=2/54=3.70%.

Even/Odd:

There are 24 even numbers and 24 odd numbers. The probability that the $5^{th}$ card will match the player's pick is 24/54. The house edge is 1−(24/54×(1+1))=6/54=11.11%.

Side Bets

Wild Viking Bet:

The probability that both the first card and the fifth card are a joker is $2\times{}_{52}P_3/{}_{54}P_5=2\times132{,}600/379{,}501{,}200=1/1431$. The house edge is 1−(1/1431×(1250+1))=12.58%.

A wild Viking occurs 2×52P3/54P5=2×132600/379501200=1/1431=0.06988%.

TABLE 5

Poker Side Bets

| Bet | % Probability | Pay | % House Edge |
|---|---|---|---|
| 4 of a kind or Better | 0.318165 | 280 | 10.5956 |
| Full house or Better | 0.614132 | 150 | 7.2660 |
| Flush or Better | 0.974226 | 90 | 11.3454 |
| Straight or Better | 2.071582 | 45 | 4.7072 |
| 3 of a kind or Better | 9.438136 | 9 | 5.6186 |
| 2 Pair or Better | 13.344906 | 6 | 6.5857 |
| Pair of 6s or Better | 48.127911 | 1 | 3.7442 |

TABLE 6

Progressive Jackpot Bets

| Hand Type | % Probability | Pay (for 1) | % Return |
|---|---|---|---|
| Wild Viking Royal Flush | 0.000126 | 10,000 | 1.2648 |
| 5 of a kind | 0.002466 | 1,000 | 2.4664 |
| Royal Flush | 0.002530 | 250 | 0.6324 |
| Straight flush | 0.017075 | 50 | 0.8538 |
| 4 of a kind | 0.295967 | 20 | 5.9193 |
| Full house | 0.295967 | 10 | 2.9597 |
| Flush | 0.360094 | 8 | 2.8807 |
| Straight | 1.097356 | 5 | 5.4868 |
| 3 of a kind | 7.366554 | 3 | 22.0997 |
| Total | 9.438136 | | 44.5636 |

The hit frequency is 9.44%.

The jackpot seed is $10,000. Suppose that 40 cents of each $1 bet goes to the meter and that 1.2648 cents of each $1 is reserved by the operator to reseed the jackpot when it's hit. The house edge is $1−$0.445636−$0.40=$0.1544 per $1 bet or 15.44%.

The jackpot will hit once every 790,627.5 hands. The average jackpot when hit will be $326,251.

CONCLUSION AND ALTERNATE EMBODIMENTS

It can be realized from the embodiments described herein that the present invention provides a modified roulette game that adds new excitement and larger rewards than traditional roulette games. The above-described embodiments of the present invention have many advantages. For instance, the embodiments that incorporate side bets and utilize the payout schedules presented above may provide the player with games that are more rewarding (for both players and casinos). In conventional roulette, a player may earn up to 35 times his original bet by correctly picking a winning number, but otherwise he is limited to winning the amount that he wagers if he simply bets on "red" or "black." In contrast, the present invention offers the possibility for a player to make side bets whereby he has an opportunity to win fifty, one thousand, or even ten thousand times his original side bet or more (see TABLES 1 and 2).

The present invention advantageously retains some of the features and advantages of roulette as well as provides the player with greater betting options and the dynamics of a side wager for enhanced player anticipation and enjoyment. A player may feel like he has more control because the present invention provides him with many more wagering options, and a player's enjoyment may also be enhanced by the possibility of far greater jackpots than are offered in traditional roulette games. The invention therefore benefits the player who desires a novel variation of roulette as well as the player who does not want to have to learn new rules for valuing cards and scoring poker-type hands, but desires some variety or desires an element of poker play. Additionally, with the incorporation of a side bet, the invention provides casinos with the potential of generating more revenue, as it is advantageous to offer roulette players some variation in the game to maintain their long-term interest.

As described in the EXAMPLES section above, certain embodiments of the present invention have reasonable odds for both the player and the casino or "house." This is another advantage of the invention because, to be a viable casino game, the gaming method should provide opportunity for a reasonable return for both the house and the player.

It is to be understood that although some advantages of the present invention are described herein, it is not necessary that all the advantageous features and/or all the advantages need to be incorporated into every embodiment of the invention.

Although the present invention has been described above in considerable detail with reference to certain versions thereof, other versions are possible. For example, the gaming method described above is not limited to being played as a table game. The gaming method may be played as a board game or by using computers or electronic devices having audio and video outputs. Thus, the term "cards" as used in this application refers to traditional cards made of paper stock having traditional game indicia, such as numbers (2-10), suits (diamonds, hearts, spades, and cloves), and characters (aces, jacks, queens, and kings). The term "cards" is also used to refer to electronic images of traditional cards. The term "dealer" may be an actual person distributing the cards. It is noted that the dealer may also be a player, and the dealer does not have to be associated with a business entity having a stake in any profits derived from operating the game. The term "dealer" may also be used to refer to a virtual dealer that is programmed through an electronic device or computer.

The invention can be readily implemented in a wide variety of additional forms and media including, but not limited to: single player slot video machines, multi-player slot video machines, electronic games and devices, lottery terminals, scratch-card formats, software, as well as in-flight, home, and Internet entertainment. Furthermore, the invention can be readily implemented in software, which can be stored on a disk (e.g., magnetic disk, compact disc (CD), USB memory stick, etc.,) and used with a computer system. In one embodiment, the gaming method of the present invention may be implemented as a computer game which may be executed via disk or downloaded from the Internet and played using a computer, gaming console, or an electronic handheld device (e.g., personal digital assistants (PDA), mobile phones, etc.). Such embodiments may be played individually or may be played with other players. In another embodiment, the present invention may be played as an interactive online gambling game wherein the player may play against the dealer individually or with other players via the Internet. The dealer may be an actual person or a virtual dealer. Similarly, the other players may be actual people or they may be computer generated virtual players. In yet other embodiments of the invention, the gaming method may be played against a casino or wagering establishment from a remote location via the Internet.

Additionally, some steps of the gaming method described herein may be added, omitted or modified. For instance, the poker-type side bets, progressive jackpot bets, and/or Wild Viking bets may or may not be used. Also, the five card values selected may be some combination of actual (or computer-generated representations of) cards and values selected from spins of a modified roulette wheel. The roulette wheel may be omitted entirely, and the game can be played with a simple 54-card deck of playing cards (or multiple decks, or computer representations thereof). Alternately, the physical playing cards may be eliminated, and any number of the five values may be determined by a spin or spins of a modified roulette wheel.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. A method of playing a modified roulette game, the method comprising:

(a) providing a standard physical deck of 54 playing cards including two joker cards, providing a wagering area, requiring each player to place at least one roulette-type bet on the wagering area comprised of:

a first betting position for inside bets wherein the first betting position comprises a grid containing four rows of thirteen columns wherein each box of the grid represents 52 different cards excluding jokers and wherein each of the four rows corresponds to a different suit and each of the thirteen columns corresponds to a different number;

a second betting position for bets on any number;

a third betting position for bets on a particular joker;

a fourth betting position for bets on a particular suit;

a fifth betting position for bets on a four-number block wherein the fifth betting position is comprised of a first block designating numbers 2, 3, 4, and 5; a second block designating numbers 6, 7, 8, and 9; and a third block designating numbers 10, J, Q, and K;

a sixth betting position for bets on a six-number block wherein the sixth betting position is comprised of a fourth block designating numbers 2, 3, 4, 5, 6, and 7 and a fifth block designating numbers 8, 9, 10, J, Q, and K;

a seventh betting position for red-black bets; and an eighth betting position for even-odd bets;

(b) allowing each player to make at least one optional side bet comprised of a wild viking bet;

(c) dealing a plurality of community card values from the standard deck of 54 cards;

(d) revealing the community card values;

(e) using a predetermined community card from the community card values to resolve the at least one roulette-type bet; and (f) resolving the at least one optional side bet wherein the wild viking bet wins if two of the community card values are jokers.

2. The method of claim 1 wherein the plurality equals five and the community card values are comprised of a first community card, a second community card, a third community card, a fourth community card, and a fifth community card.

3. The method of claim 2 wherein the predetermined community card is the fifth community card.

4. The method of claim 2 wherein the at least one optional side bet further comprises a poker bet wherein the poker bet is based on forming a winning 5-card poker hand comprising the first community card, the second community card, the third community card, the fourth community card, and the fifth community card and wherein the wild viking bet wins if the first community card and the fifth community card are both jokers.

5. The method of claim 1 wherein the at least one optional side bet comprises a progressive jackpot bet.

6. A method of playing a modified roulette game, the method comprising:

(a) providing a standard physical deck of 54 playing cards including two joker cards, providing a wagering area, requiring each player to place at least one roulette-type bet on the wagering area comprised of:

a first betting position for inside bets wherein the first betting position comprises a grid containing four rows of thirteen columns wherein each box of the grid represents 52 different cards excluding jokers and wherein each of the four rows corresponds to a different suit and each of the thirteen columns corresponds to a different number;

a second betting position for bets on any number;

a third betting position for bets on a particular joker;

a fourth betting position for bets on a particular suit;

a fifth betting position for bets on a four-number block wherein the fifth betting position is comprised of a first block designating numbers 2, 3, 4, and 5; a second block designating numbers 6, 7, 8, and 9; and a third block designating numbers 10, J, Q, and K;

a sixth betting position for bets on a six-number block wherein the sixth betting position is comprised of a fourth block designating numbers 2, 3, 4, 5, 6, and 7 and a fifth block designating numbers 8, 9, 10, J, Q, and K;

a seventh betting position for red-black bets; and an eighth betting position for even-odd bets;

(b) allowing each player to make at least one optional side bet comprised of a poker bet and a wild viking bet;

(c) dealing a first community card, a second community card, a third community card, a fourth community card, and a fifth community card from the standard deck of 54 cards;

(d) revealing the first community card, the second community card, the third community card, the fourth community card, and the fifth community card;

(e) using the fifth community card to resolve the at least one roulette-type bet; and (f) resolving the at least one optional side bet wherein the wild viking bet wins if the first community card and the fifth community card are jokers.

7. The method of claim 6 wherein the poker bet is based on forming a winning 5-card poker hand comprising the first community card, the second community card, the third community card, the fourth community card, and the fifth community card.

8. The method of claim 6 wherein the at least one optional side bet comprises a progressive jackpot bet.

* * * * *